United States Patent [19]

Dunn et al.

[11] Patent Number: 5,060,935

[45] Date of Patent: Oct. 29, 1991

[54] WATER IMMERSED STAIR CLIMBER

[76] Inventors: Thomas J. Dunn, 7963 Glen Abby Cir., Orlando, Fla. 32819; Donald B. Gronachan, 4 Spiral Rd., Holtsville, N.Y. 11742

[21] Appl. No.: 638,237

[22] Filed: Jan. 7, 1991

[51] Int. Cl.[5] ..... A63B 21/20; A63B 23/04

[52] U.S. Cl. ..... 272/70; 272/130

[58] Field of Search ..... 272/69, 116, 130, 70, 272/1 B, 117, 125

[56] References Cited

U.S. PATENT DOCUMENTS 3,424,133 1/1969 Brady .
4,162,788 7/1979 Turnier .
4,249,725 2/1981 Mattox ..... 272/130
4,708,338 11/1987 Potts .
4,759,544 7/1988 Diaz .
4,776,581 10/1988 Shepherdson .
4,838,543 6/1989 Armstrong et al. .

FOREIGN PATENT DOCUMENTS 3600061 7/1987 Fed. Rep. of Germany .

*Primary Examiner*—Stephen R. Crow
*Attorney, Agent, or Firm*—Leonard Belkin

[57] ABSTRACT

Stair climbing exercising apparatus for use under water comprising a pair of laterally adjacent stepping levers pivotally mounted between the two ends of the levers, the exerciser stepping on one end, and water resistance imposing member mounted the levers. The amount of water resistance being imposed is adjustable. In another embodiment, a paddle wheel is employed with blades along the outer periphery being adjustable to vary the amount of water resistance.

4 Claims, 3 Drawing Sheets

10
12
14
16
18
22
24
26
28
32
34
36
38
42
44
3
4
5
6

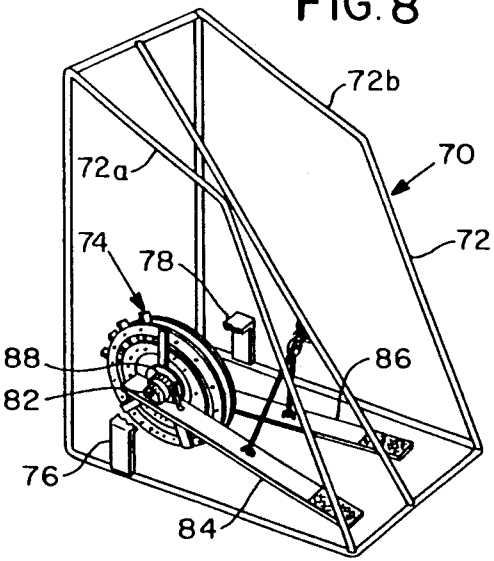
FIG. 8
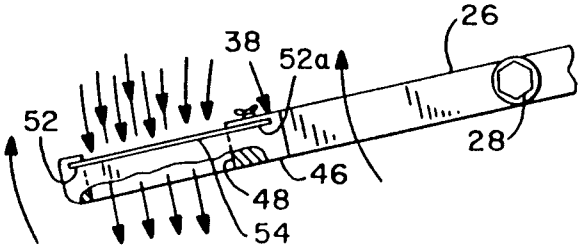
FIG. 7a
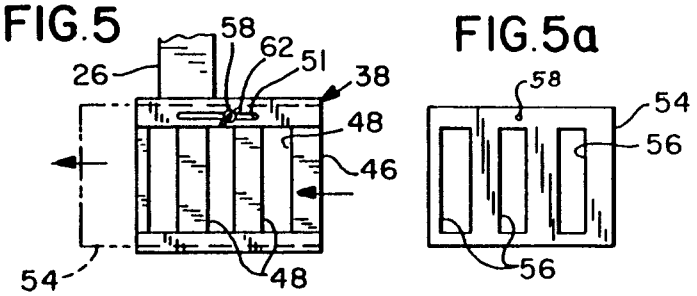
FIG. 5a
FIG. 5
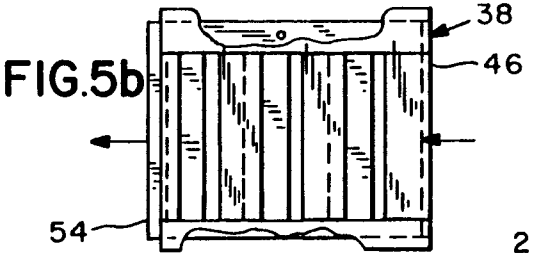
FIG. 5b
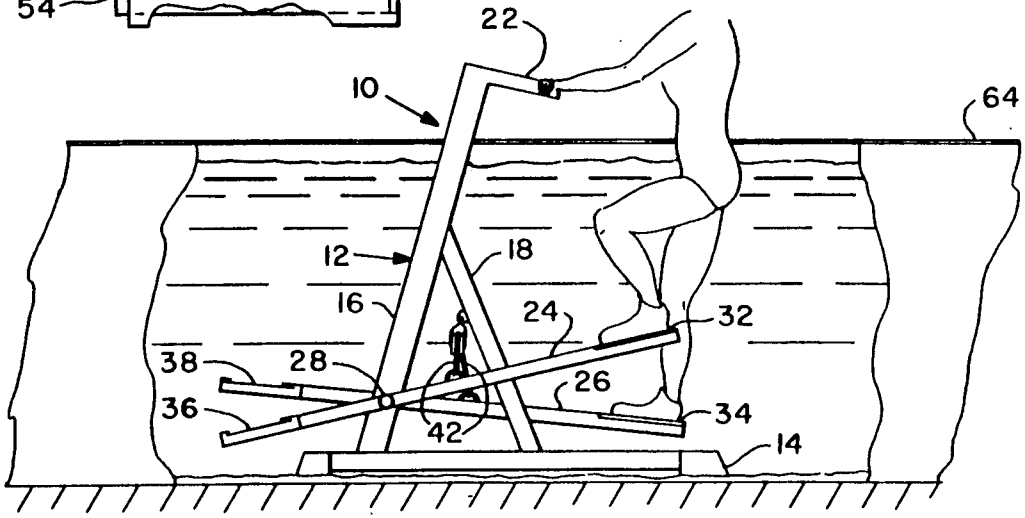
FIG. 7

WATER IMMERSED STAIR CLIMBER

BACKGROUND OF THE INVENTION

This invention relates to stair climber exerciser apparatus and more particularly to stair climber exercise apparatus for use under water.

Climbing is the most popular club exercise today, presumably because it is a low impact activity with an excellent combination of aerobic and anaerobic exercise.

For persons who are very overweight, or persons who are just beginning to undertake this type of an exercise program and thus are not in proper condition, climbing may be, initially at least, a risky endeavor even after examination by a physician and under close supervision.

A variety of climbing and related type of exercise equipment are shown in the following United States Patents:

U.S. Pat. No. 3,424,133 shows an exercising device for attachment to the legs of a horse for use under water.

U.S. Pat. No. 4,162,788 discloses swimming and exercising apparatus utilizing wheel members having cogs thereon with pedals for producing the exercise.

U.S. Pat. No. 4,551,108 describes an exercise device for use under water in which the exerciser is suspended in a harness.

U.S. Pat. No. 4,708,338 discloses step climbing apparatus with pedals and drive sprockets. An alternator functions as a dynamic brake.

U.S. Pat. No. 4,759,544 shows an aquatic exercise apparatus set in a tank of water utilzing a pivoting platform.

U.S. Pat. No. 4,776,581 shows exercise apparatus for under water use in which a number of arrangements are disclosed, including bike riding and trampoline type of activities.

U.S. Pat. No. 4,838,543 discloses exercise apparatus with pedals and hydraulic cylinders to produce the resistance.

German patent DE 3600061 describes under water bicycling apparatus for providing exercise.

None of the foregoing patents teaches the present invention.

SUMMARY OF THE INVENTION

The present invention relates to stair climbing apparatus designed for use under water, such as in a swimming pool, which takes advantage of the buoyancy of the human body in water to reduce some of the stresses arising from the weight of the body.

One preferred embodiment of the invention consists of stepping levers pivoted together for reciprocal motion in opposition to each other. The proximal ends of the stepping levers are provided with foot pads while the distal ends are provided each with a paddle which can adjust the amount of resistance presented by the water to the pumping action by the exerciser. The paddles can be placed on the proximal ends instead if desired.

The arrangement is simple and economic in construction, reliable in use, and relatively light in weight. With this invention it is not necessary to incorporate into the apparatus any elaborate resistance mechanism since water provides that resistance.

Other advantages of this invention include the cooling effect which is highly effective to prevent overheating when exercising in the summer.

In addition, this invention is highly beneficial for use in rehabilitation programs for injured persons where it is necessary to avoid stress on joints which would arise during exercising due to body weight. Furthermore, for grossly overweight person who is undertaking a physical fitness program it makes it possible for such persons to start a program where he or she otherwise could not enter such a program due to their body weight. By adjusting the height of the water it is possible to control the amount of buoyancy present and the fraction of the body weight which is being carried by the exerciser while using the apparatus of this invention. This invention could serve to increase the use of swimming pools in fitness clubs, exercise centers, etc.

It is thus a principal object of this invention to provide stair climbing apparatus suitable for use under water.

Other objects and advantages of this invention will hereinafter be obvious from the following detailed description of preferred embodiments of this invention.

BRIEF DESCRIPTION OF THE DRAWINGS

FIG. 5 is a view taken along 5—5 of FIG. 2.

FIG. 5*a* is a view similar to FIG. 5 of the insert.

FIG. 5*b* is a view similar to FIG. 5 with the paddle adjusted for high water resistance.

FIG. 7 is a view similar to that of FIG. 2 with the preferred embodiment in use under water.

FIG. 7*a* is a detail of FIG. 7 illustrating the operation of a paddle.

FIG. 8 is a perspective view, partially schematic, of another preferred embodiment of this invention.

DESCRIPTION OF THE PREFERRED EMBODIMENTS

Figures 1, 2, 3, 4, 6:
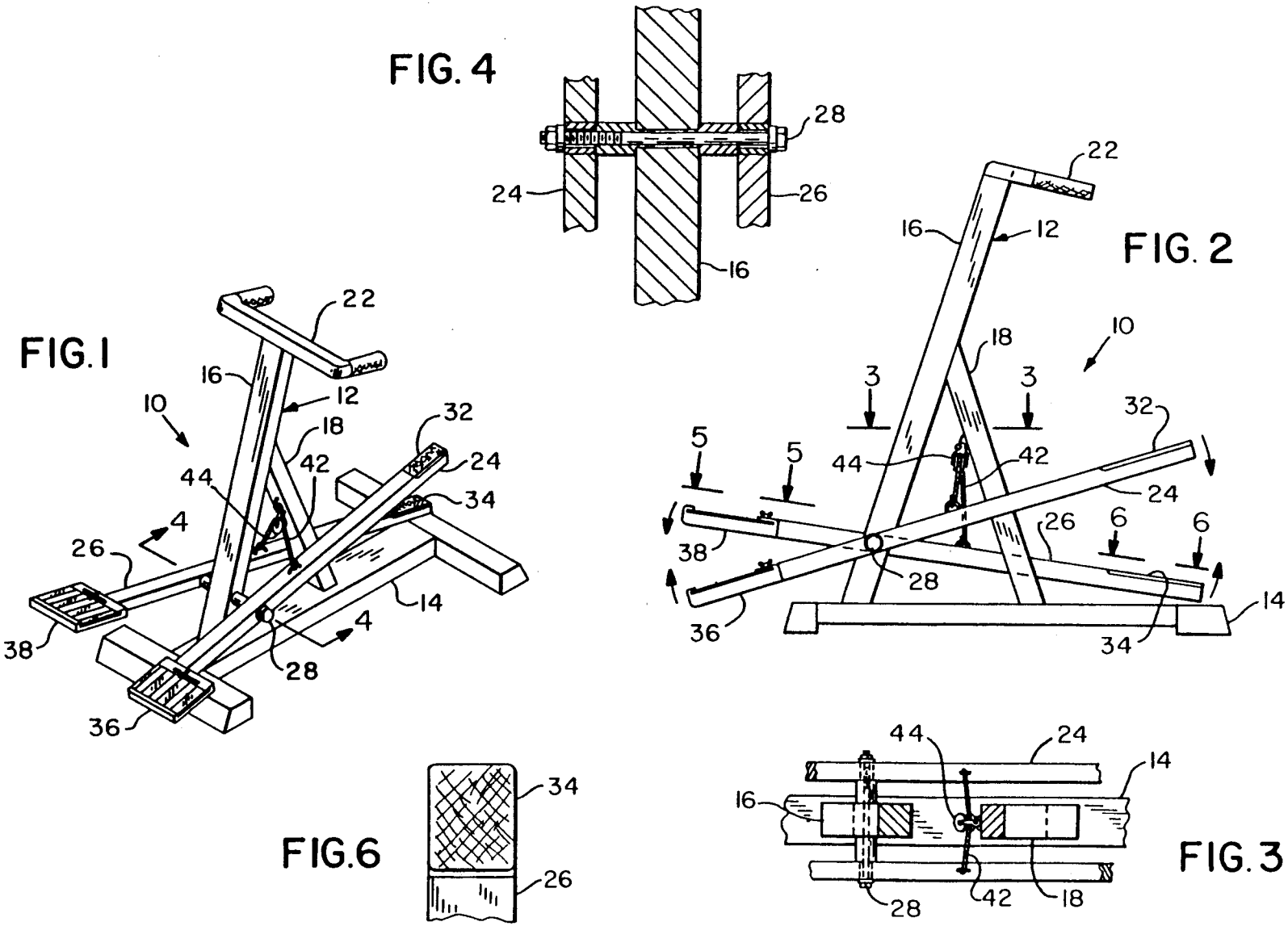
FIG. 1 is a perspective view of a preferred embodiment of this invention.
FIG. 2 is a side elevation view of the embodiment shown in FIG. 1.
FIG. 3 is a section view taken along 3—3 of FIG. 2.
FIG. 4 is a section view taken along 4—4 of FIG. 1.
FIG. 6 is a view taken along 6—6 of FIG. 2.

Referring to FIGS. 1-6, stair climber 10 consists of a stationary frame 12 comprising an H-shaped horizontally extending platform 14 supporting a upwardly extending member 16 buttressed by a leg 18. A handgrip or handlebar 22 is attached to the top of member 16.

Mounted pivotally on member 16 are a pair of left and right stepping levers 24 and 26. A shaft 28 passes through member 16 and stepping levers 26 and 28 to provide this pivoting action.

The proximal ends of stepping levers 24 and 26 are provided with foot pads 32 and 34, respectively. The distal ends of stepping levers 24 and 26 are provided with paddles 36 and 38, respectively, which will be more fully described below.

Stepping levers 24 and 26 are linked together by a cable 42 passing over a pulley wheel 44 and whose ends are joined to stepping levers 24 and 26 in the manner illustrated. Thus, when left lever 24 is moving clockwise as shown by the arrows in FIG. 2, right stepping lever 26 will be constrained to move counterclockwise. In this way, stepping levers 24 and 26 will always be out of phase with each other and moving in opposite directions.

To introduce adjustable resistance to the movement of stepping levers 24 and 26, referring more particularly to FIGS. 1 and 5*a*–5*c*, similar paddles 36 and 38 are provided as shown. Paddle 38, for example, consists of a stationary element 46 with openings 48 and a slot 51. Slidable member 54 is mounted to ride within stationary element 46 by way of slots 52 and 52*a* shown in FIG. 7*a* with openings 56 to correspond to openings 48 in stationary element 46. Mounted on slidable member 54 is a threaded bolt 58 which extends through slot 52 when member 54 is within stationary element 46, and a wing nut 62 is employed to lock slidable member 54 in place. By moving slidable member 54 within stationary element 46, as seen in FIGS. 5 and 5*b* it is possible to adjust the alignment of openings 48 and 56 with each other, and hence the opening through paddle 38 and the amount of resistance to water as seen in FIG. 7*a*.

If desired, paddles 36 and 38 may be placed on the proximal ends of stepping levers 24 and 26, and in addition, may be built into foot pads 32 and 34.

In using stair climber 10, as seen in FIG. 7, the unit is placed in a pool 64 of water as illustrated, and the exerciser stands on foot pads 32 and 34, holding on the hand grip or handle bars 22, pumping the legs to simulate the walking up on stairs, to obtain the aerobic and anaerobic benefits of this exercise equipment. The level of water within pool 64 may be adjusted to control the amount of weight to be carried by the exerciser as long as the water covers paddles 36 and 38. In a particular program, the exerciser can start out with his body immersed up to the neck, and as his condition improves, the water level can be lowered in stages, if desired and appropriate leaving more and more of his body above the water and thus more weight to carry.

Figure 11:
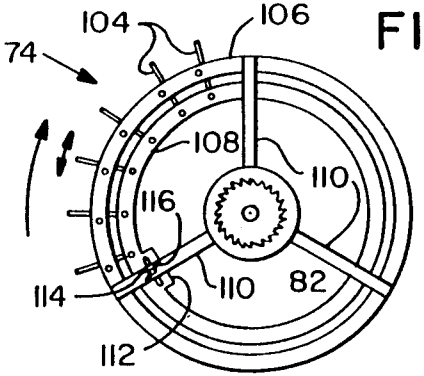
FIG. 11 is a detailed side elevation view of the paddle wheel used in the embodiment of FIGS. 8-10.
Figure 12:
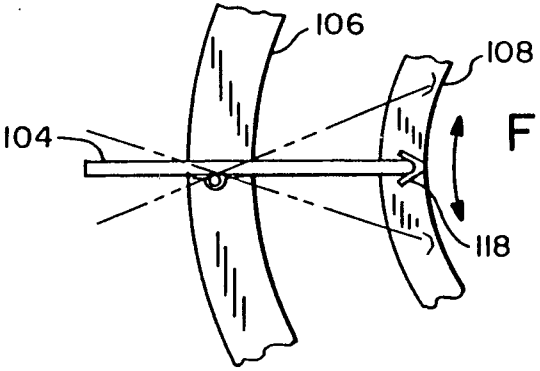
FIG. 12 is a detail of FIG. 11 showing operation of the means for adjusting the resistance to water flow.
Figure 13:
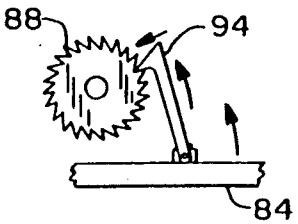
FIG. 13 is a detail of a ratchet wheel shown in FIG. 8.
Figure 10:
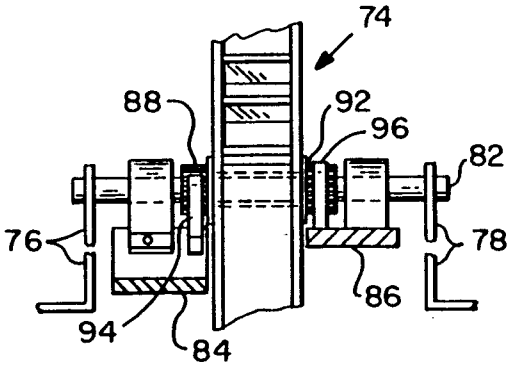
FIG. 10 is a view taken along 10—10 of FIG. 9.
Figure 9:
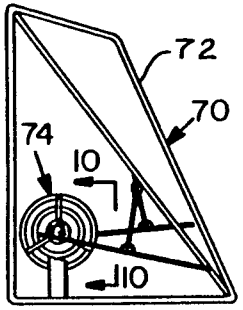
FIG. 9 is a side elevation view of the embodiment shown in FIG. 8.
Figure 14:
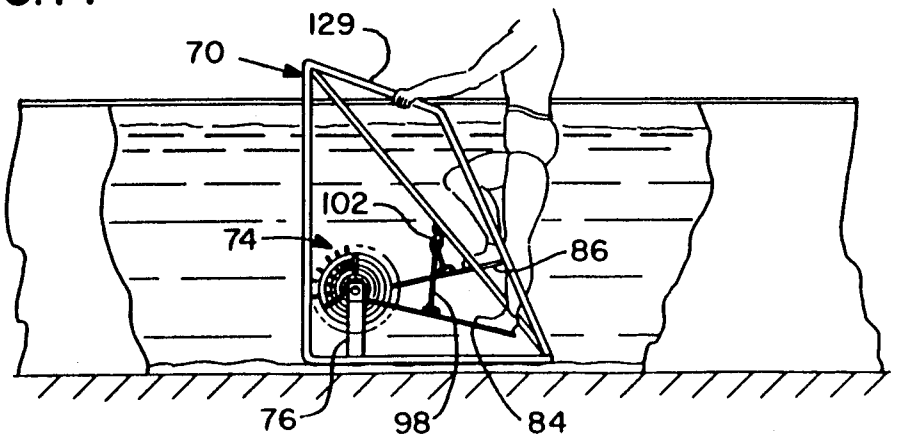
FIG. 14 is a view similar to that of FIG. 9 showing the use under water of that embodiment.

Another preferred embodiment of this invention is shown in FIGS. 8–13. Stair climber 70 consists of a hollow frame 72 in which is mounted a rotatable paddle wheel 74 supported by brackets 76 and 78 on a shaft 82. A pair of left and right stepping levers 84 and 86, respectively, are mounted for reciprocal motion on shaft 82. Paddle wheel 74 is driven by a pair of ratchets 88 and 92 and pawls 94 and 96, respectively, as seen in FIG. 13 each time stepping lever 84 or 86 is depressed by the leg of the exerciser as shown in FIG. 14.

Stepping levers 84 and 86 are linked together by way of a cable 98 riding over a pulley 102 tp provide synchronism as described in connection with the embodiment shown in FIGS. 1–7*a*.

As seen best in FIGS. 11 and 12, to control the level of resistance in stair climber 70, paddle wheel 74 is provided on its circumerence with a plurality of outwardly extending, but adjustable blades 104 which are pivoted on an outer ring 106 which is spaced from an inner ring 108 supported by radially extending struts 110. Inner ring 108 is permitted limited roational movement with respect to outer ring 106 by the use of a slotted section 112 extending from inner ring 108 and the use of a bolt 114 passing through a strut 110 with a wing nut 116 for locking purposes.

The inner ends of blades 104 as seen in FIG. 12 are fixed by cups 118 so that as inner ring 108 is rotated with respect to outer ring 106 it is possible to increase or decrease the surface area of blades 104 which come into contact with the water. Also, the faster paddle wheel 74 rotates, the more resistance is created so that in this embodiment also a more pronounced resistance effect is produced without relying on the weight of the body itself.

Wing nut 116 locks the position of blades 104, and to adjust their position, lock nut 116 would be loosened, inner ring 108 rotated to its desired position, and then lock nut 116 would be tightened to lock in that position.

As seen in FIG. 14, stair climber 70 is placed in a swimming pool, hot tub, or the like, and the exerciser steps on the proximal ends of the stepping levers 84 and 86, grasps the handle bar sections 72*a* and 72*b* of frame 72, pumps his or her feet to simulate stair climbing. Water level as previously described, may be adjusted for the amount of body weight to be carried by the exerciser.

It is thus seen there has been provided unique stair climbing apparatus for use under water which provides stepping resistance without relying on the body weight of the exerciser.

While only certain preferred embodiments of this invention have been described it is understood that many variations are possible without departing from the principles of this invention as defined in the claims which follow.

What is claimed is:

1. Stair climbing apparatus for use by an exerciser comprising:

a. support frame means including a ground engaging base immersed in water;

b. a pair of laterally adjacent foot stepping levers pivotally mounted on said support frame means at a location above said base, c. synchronizing means mounted on said support frame means attached to each of said stepping levers so that when one of said levers is pushed down by said exerciser the other said lever is raised; and d. resistance means mounted on said stepping levers for relying on said water to resist pivotal movement of said stepping levers said apparatus being sufficiently immersed so that the water level is above said resistance means, said resistance means comprises a paddle; whereby said stepping levers are extended with said exerciser standing on the proximal ends of said levers, said levers being pivoted at points intermediate of the proximate and distal ends thereof, and said resistance means being mounted on the distal ends of said levers.

2. The stair climbing apparatus of claim 1 wherein said peddle has having a stationary member and a member slidable with respect to said stationary member, each of said members having openings, said slidable member having means to adjust the overlapping of the openings in said stationary and slidable members to adjust the resistance as said stepping levers pivot within said water.

3. The method of exercising comprising the steps of:

a. immersing stair climbing apparatus in water, said stair climbing apparatus comprising support frame means including a ground engaging base, a pair of laterally adjacent foot stepping levers pivotally mounted on said support frame means at a location above said base, said stepping levers being extended with said levers being pivoted at points intermediate the proximate and distal ends of said levers, means mounted on said support frame means attached to each of said stepping levers to synchronize the movement of said levers, and resistance means mounted on the said stepping levers for relying on said water to resist pivotal movement of said stepping levers, said apparatus being immersed sufficiently to cover said resistance means said resistance means comprises a paddle; whereby said stepping levers are extended with said exerciser standing on the proximal ends of said levers, and said resistance means being mounted on the distal ends of said levers; and b. stepping on the proximal ends of said levers to produce reciprocal motion of said levers with resistance by said water being introduced by said resistance means.

4. The method of claim 3 in which the level of said water is adjusted to control the amount of body weight being supported while exercising.

* * * * *